United States Patent [19]

Krause

[11] Patent Number: 4,972,923

[45] Date of Patent: Nov. 27, 1990

[54] LADDER PLATFORM

[75] Inventor: Guenther Krause, Alsfeld, Fed. Rep. of Germany

[73] Assignee: Krause-Werk GmbH & Co. KG, Alsfeld, Fed. Rep. of Germany

[21] Appl. No.: 400,554

[22] Filed: Aug. 30, 1989

[30] Foreign Application Priority Data

Sep. 1, 1988 [DE] Fed. Rep. of Germany ... 8811070[U]

[51] Int. Cl.[5] ..... E06C 7/16

[52] U.S. Cl. ..... 182/121; 248/238

[58] Field of Search ..... 182/121, 120, 122, 92; 248/238

[56] References Cited

U.S. PATENT DOCUMENTS

| | | | |
|---|---|---|---|
| 1,920,552 | 8/1933 | Dollerhide | 182/121 |
| 2,151,135 | 3/1939 | Moberg | 182/121 |

FOREIGN PATENT DOCUMENTS

| | | | |
|---|---|---|---|
| 1179970 | 2/1970 | United Kingdom | 182/121 |
| 1512155 | 5/1978 | United Kingdom | 182/121 |
| 2036152 | 6/1980 | United Kingdom | 182/121 |

*Primary Examiner*—Reinaldo P. Machado

*Attorney, Agent, or Firm*—Flynn, Thiel, Boutell & Tanis

[57] ABSTRACT

Stepping platforms, like storage platforms suspendable on a ladder, are known from the state of the art. However, these are not variable in use and in particular cannot simultaneously meet both functions. The invention provides, that a suspension link is supported on one end of a plate with a peripheral edge, while a mounting element is provided on the other end, which mounting element can include two mounting plates, which are supported pivotally on the outside of the plate and include a recess into which a ladder crosspiece is receivable. The inventive ladder platform can be used as an accessory for all types of ladders.

11 Claims, 3 Drawing Sheets

FIG. 4
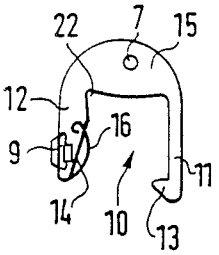
FIG. 3
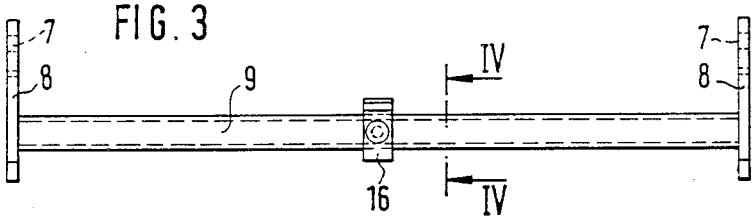
FIG. 5
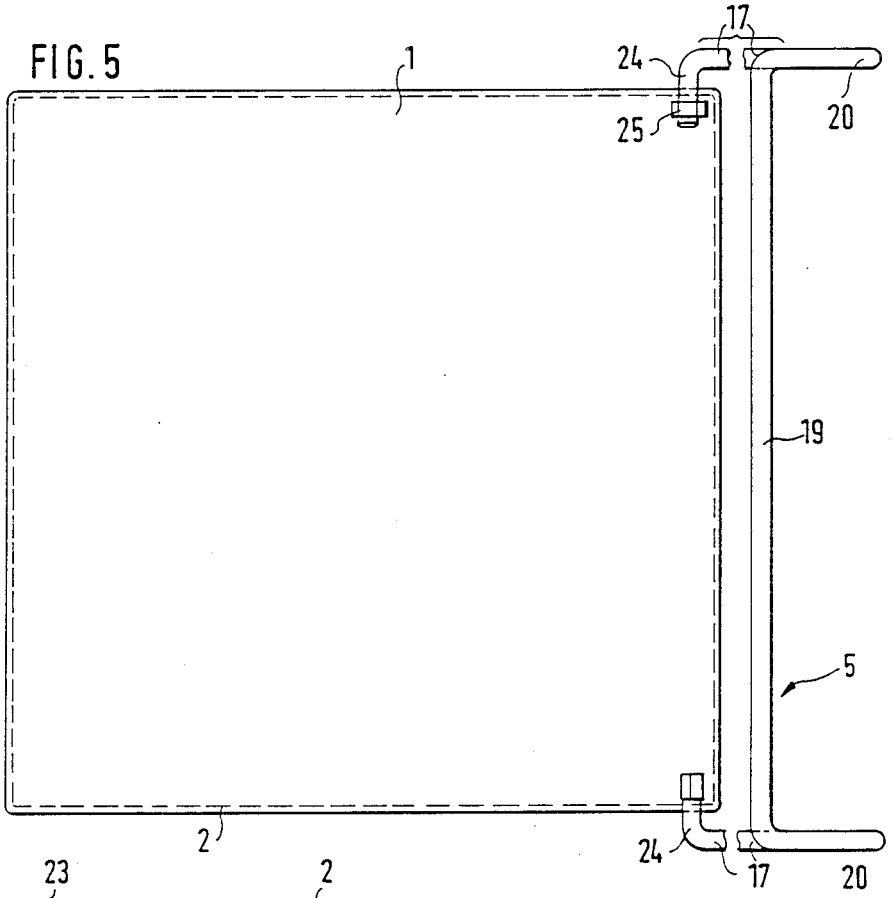
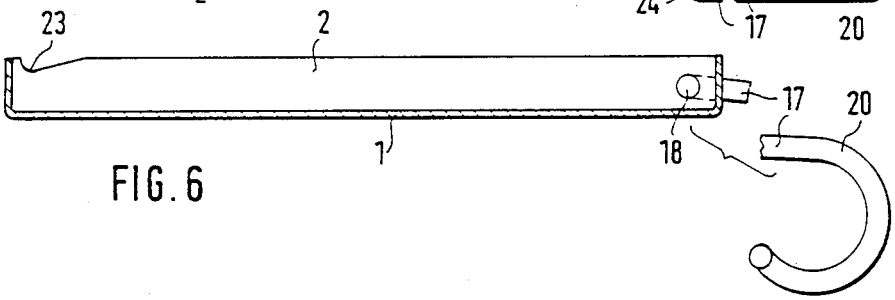
FIG. 6

LADDER PLATFORM

FIELD OF THE INVENTION

The invention relates to a ladder platform comprising a plate including a peripheral edge extending from one side of the plate and placeable at its first end on a crosspiece of a ladder and comprising a suspension link supported on the second end of the plate and attachable to a crosspiece, of the ladder.

BACKGROUND OF THE INVENTION

Many designs for ladder platforms are known from the state of the art. These ladder platforms form a stepping platform, on which an operator can stand safely and comfortably during longer periods of time on the ladder.

Furthermore ladder platforms are known, which are only used to store articles or tools, for example a paint bucket or building parts to be installed.

The known ladder platforms forming a stepping platform have the disadvantage, that, when the platforms are used to store tools or other items, an edge preventing the falling off or rolling off of tools or articles does not exist. On the other hand, the known platforms created for storing articles are not stepping platforms, since the existing edge significantly interferes with the stepping movement.

The basic purpose of the invention is to produce a ladder platform of the above-mentioned type, which with a simple design and operatively safe maneuverability can be utilized both as a stepping platform and also as a storage platform.

SUMMARY OF THE INVENTION

The purpose of the invention is attained by a mounting element pivotal about an axis, which is parallel with respect to the plate, being supported on the first end of the plate, which mounting element can form-lockingly engage a crosspiece.

The inventive ladder platform is distinguished by a number of considerable advantages. The inventive plate has a peripheral edge at one side, so that the plate assumes the shape of a flat bowl or a cornered bowl. The other side of the inventive plate is completely flat, so that it is possible without obstacles to stand on the plate, without having to step on an edge. The flat design of the plate furthermore makes it possible in a particularly simple manner to coat the stepping surface of the plate in a suitable manner, for example with a layer for preventing slipping.

By supporting the plate by means of the mounting element, which can engage a crosspiece, it is possible in a simple and safe manner to turn the plate in order to one time arrange the completely smooth outside serving as the stepping side on top and another time, when the ladder platform is used for storage, have the edge of the plate point upwardly.

The possibility of the invention, that the mounting element can form-lockingly engage a crosspiece, assures at all times a safe mounting of the plate, thus preventing the plate from becoming loose from the web due to stress.

A favorable further development of the invention provides, that the mounting element includes two mounting plates which are each pivotally supported on the outside of the edge of the plate, and a web connecting the mounting plates, and that the mounting plates are each provided with a recess for receiving the crosspiece. The support of the mounting plates on the outside makes it possible to pivot these without obstacles relative to the plate in order to turn the plate in its arrangement. Since the two mounting plates are connected by means of a web, it is assured, that both mounting plates each simultaneously engage the crosspiece. Thus an incorrect arrangement of the inventive platform is impossible.

The recess in the mounting plates for mounting onto the crosspiece makes it possible in a particularly simple manner to find an association of the mounting plates or of the mounting element with the crosspiece and in particular to assure a form-locking connection.

Each mounting plate has in a particularly favorable design, which can be manufactured in a particularly simple manner, a U-shaped cross section. This permits a safe mounting on the crosspiece and guarantees a sufficient form-locking contact. Furthermore a first leg of the U-shaped cross section can have a locking projection directed toward the second leg, which locking projection is dimensioned such, that same, when the first leg rests on a side surface of the crosspiece, undercuts the crosspiece and prevents the mounting element from slipping off of the crosspiece.

To assure the crosspiece to be guided sufficiently into the inside of the U-shaped mounting plate profile, the second leg can have an incline. Since usually today's ladders have crosspieces having a rectangular or square cross section, it is thus possible in a particularly simple manner to guide the crosspieces into the recess of the mounting plate and have said crosspiece through a slight rotation form-lockingly engage said mounting plate, in particular the locking projection provided on the first leg.

The web connecting the two mounting plates is fastened preferably on the second leg of the U-shaped cross section or profile of the mounting plate in order to assure in this manner an adjustment or pivoting as large as possible of the mounting plate.

In order to guarantee a sufficient pivoting capability of the mounting plates relative to the plate or to the edge of the plate, the base area of the U-shaped cross section of each mounting plate each is supported in an advantageous manner pivotally on the edge of the plate. This has proven to be particularly favorable also in view of strength problems, since it is easily possible to suitably dimension the base area.

The web can, in a particularly advantageous embodiment of the invention, be biased away from the crosspiece by means of an elastic element. The initial bias assures, that the first leg and the locking projection rest at all times in a safe manner against the crosspiece. An incorrect operation is thereby not possible, since the operator, when moving the mounting plates onto the crosspiece, must automatically bring the elastic element into engagement with the crosspiece, so that thus the suitable initial biasing force is automatically produced.

It can thereby be advantageous to arrange the elastic element in the center area of the web, since the use of one single elastic element, for example a spring, can be sufficient in this embodiment.

The suspension link has in a further, particularly favorable development of the invention two parallel bars, which at one end are each supported pivotally about an axis parallel with respect to the pivot axis of the mounting element on the edge of the plate, with the other ends of the bars each being bent partly circularly and being connected by means of a diagonal trussing. It is possible with this design of the inventive suspension link to attach said suspension link to a crosspiece due to the partly circular bend, with the bar being able to be arranged embracing the crosspiece either from below or being able to be attached to the crosspiece such, that it embraces same from above. These different possibilities of attachment make it possible to attach the plate in many different positions to a ladder, without having to remove and turn over the suspension link. Furthermore it is not necessary according to the invention to provide additional attachment and support mechanisms which would be usable only for one purpose, either as a stepping platform or as a storage platform.

It can be furthermore advantageous to provide a recess on the edge of the plate facing the mounting element, by means of which recess the plate, when used as a stepping platform, can in addition form-lockingly engage the crosspiece.

BRIEF DESCRIPTION OF THE DRAWINGS

The invention will be described hereinafter in connection with one exemplary embodiment and the drawings.

In the drawings:

FIG. 3 is a top view of the inventive mounting element, FIG. 4 is a cross-sectional view along the line IV—IV of FIG. 3, FIG. 5 is a top view of a portion of the inventive ladder platform, and FIG. 6 is a cross-sectional view of the portion of the ladder platform shown in FIG. 5.

DETAILED DESCRIPTION

Figure 1:
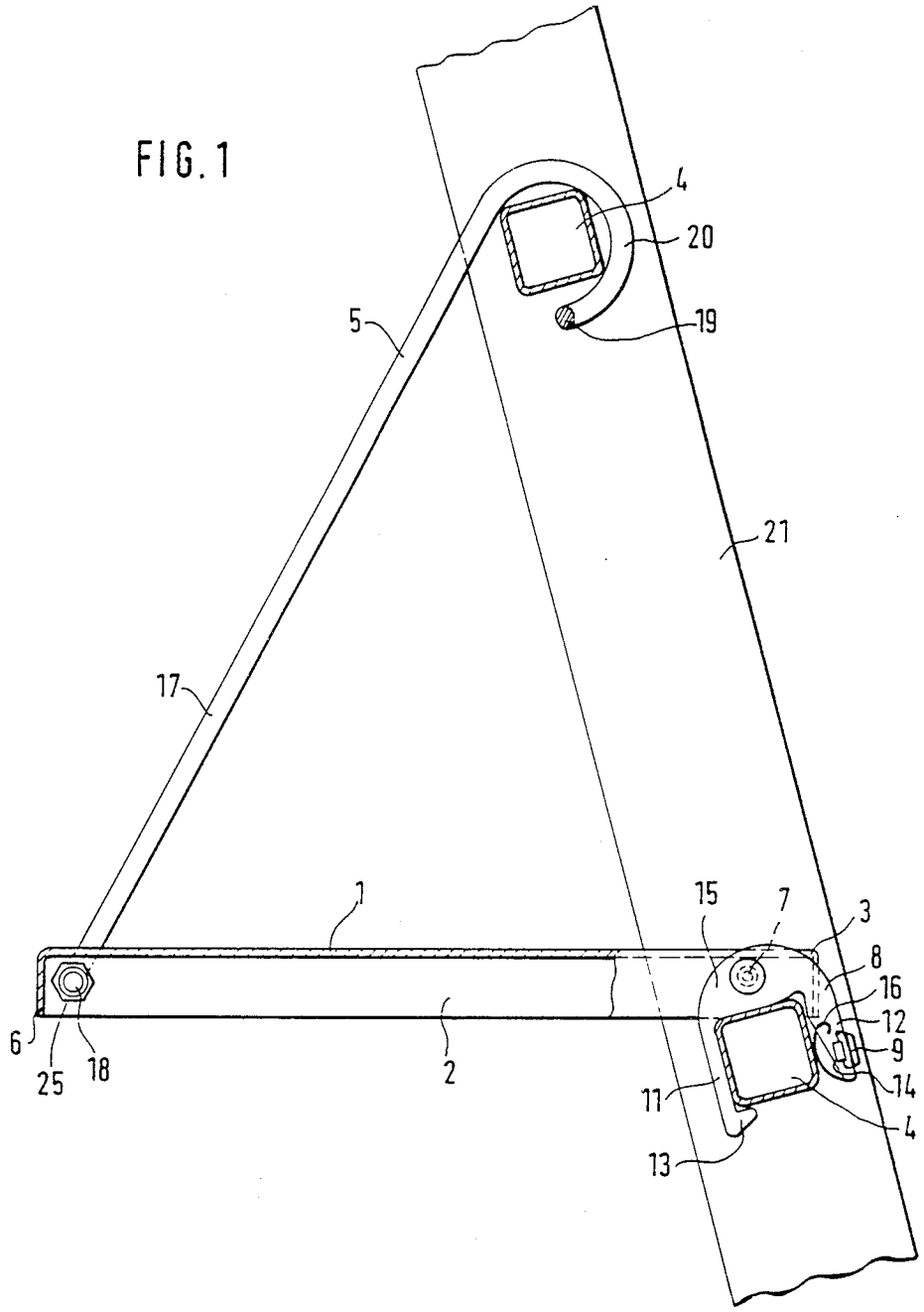
FIG. 1 is a simplified side view of the inventive ladder platform used as a stepping platform, FIG. 2 a view similar to FIG. 1, in which the ladder platform is used as a storage shelf.
Figure 2:
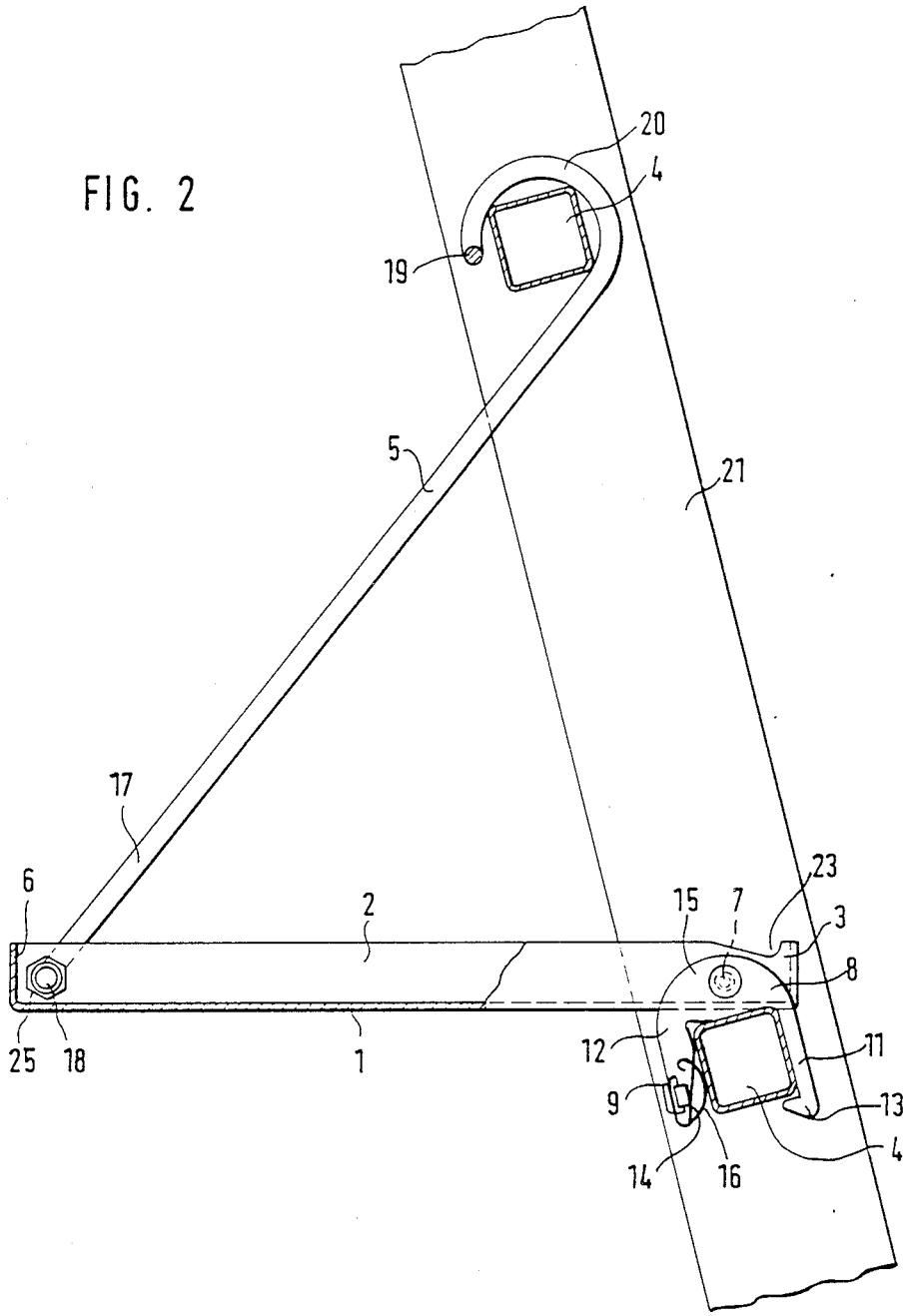

FIGS. 1 and 2 illustrate a side view of an exemplary embodiment of the inventive ladder platform.

The ladder used in connection with the platform includes two parallel sidepieces 21, which, in the usual manner, can be constructed in the form of a rectangular profile. Crosspieces 4 are fastened in the usual manner to the sidepieces 21 which crosspieces, also in the usual manner, have a square profile.

The inventive ladder platform includes a plate 1, which is constructed, substantially square,. or rectangularly. An upstanding peripheral edge 2 is provided all around the plate extending from one surface of the plate, which edge can be constructed for example by bending areas of the plate 1. Thus the plate 1 forms with the edge 2, as is particularly shown in FIG. 2, a flat bowl.

A first end 3 of the plate is pivotally connected to a mounting element, which includes two mounting plates 8, which are supported laterally on the edge of the plate, namely on the outer side of the edge 2, in such a manner, that they are pivotal about an axis 7. The axis 7 is arranged substantially parallel with respect to the plane of the plate 1.

The two holding plates 8 have, as can be seen from FIGS. 1, 2 and 4, a U-shaped cross section, with one base area 15 of the U-shaped cross section being supported pivotally on the edge 2. A first leg 11 is provided with a locking projection 13 at its free end, with the first leg 11 and the locking projection 13 being dimensioned such, that, as shown in FIGS. 1 and 2, a square crosspiece profile of the crosspieces 4 can be form-lockingly embraced. A second leg, 12 forms together with the first leg 11 a recess 10 of the mounting plate 8, which is dimensioned such, that the crosspiece 4 can be guided into the recess 10 without jamming. The second leg 12 has for this purpose an incline 14 arranged on the free end of the second leg 12 and opposite the first leg 11. In order to prevent a jamming of the crosspieces 4 in a safe manner, a notch 22 can furthermore be provided at the transition from the second leg 12 to the base area 15, as this is shown in FIG. 4.

The two second legs 12 are connected through a web 9 illustrated in cross section in FIGS. 1, 2 and 4. The web 9 may also have a substantially U-shaped cross section.

To assure, that the first leg 11 and the locking projection 13 and also the base area 15 are in contact with the crosspiece, an elastic element 16 is provided, as this is illustrated in FIG. 3, in the center area of the web 9. Said elastic element 16 is constructed like a pressure spring, as is shown in FIGS. 1, 2 and 4. The elastic element 16 assures, that the second leg 12 of the respective mounting plate 8 is being pressed away from the crosspiece 4.

The edge 2 of the plate 1 has in the area of the first end 3 a recess 23, which is formed such, that the edge 2, in the arrangement of the plate 1 shown in FIG. 1, can engage form-lockingly the crosspiece 4 in order to guarantee an additional anchoring.

Furthermore, a suspension link 5 is supported on the second end 6 of the plate 1 opposite the mounting element on and the edge 2 of said plate 1, which suspension link 5 is pivotal about an axis 18, which is arranged parallel with respect to the axis 7. The second end 6 of the plate 1 is mounted in this manner. The suspension link 5 has two bars 17, which are parallel to one another and which are arched at their free ends 20 and are connected with one another through a diagonal trussing 19. The ends 20 of the bars 17 are designed such in their bend, that a partial embracing or enclosing of a crosspiece 4 is possible.

FIG. 1 shows an arrangement of the ladder platform of the invention, in which it serves as a stepping platform. The plate 1 points thereby upwardly, while the edge 2 is arranged downwardly. The suspension link 5 is attached to the upper crosspiece 4 in such a manner, that it at least partially embraces said upper crosspiece from above. Furthermore the recess 23 of the edge 2 is form-lockingly engaged with the lower crosspiece 4. The two mounting, plates 8 of the mounting element are moved over the lower crosspiece 4 and embrace said lower crosspiece form-lockingly such, that the elastic element 16 causes an abutment of the first leg 11, of the locking projection 13 and of the base area 15 against the respective sides of the lower crosspiece 4.

FIG. 2 shows an arrangement of the inventive ladder platform, in which same serves as a storage platform. The plate 1 is arranged such for this purpose, that the edge 2 projects upwardly. The suspension link 5 embraces an upper crosspiece 4 of the ladder, while the mounting plates 8 of the mounting element are in turn mounted on a lower crosspiece 4. The elastic element 16 also in this case causes an abutment of the first leg 11, of the locking projection 13 and of the base area 15 against the respective sides of the crosspiece 4.

FIG. 3 is a top view of the web 9 and of the two mounting plates 8 showing in particular the arrangement of the two mounting plates and of the elastic element 16.

FIG. 4 is a cross-sectional view along the line IV-IV of FIG. 3 particularly clearly showing hereby again the design of the mounting plates 8.

FIG. 5 is a top view of the plate 1, however, not showing the mounting plates 8 and the webs 9. Rather, the suspension link 5 is shown in detail. The ends 24 of the bars 17, which ends face the plate 1, are either guided received in recesses of the edge 2 of the plate 1 or are supported in additional bearing blocks not illustrated in detail. It is also possible to screw a screw 25 onto each free end of the ends 24 in order to prevent the bars 17 from slipping out of the edge 2.

FIG. 6 is a cross-sectional view of the arrangement shown in FIG. 5 with the suspension link 5 being shown shortened in particular with respect to the bars 17.

The inventive ladder platform for the first time created the possibility to construct with only one platform both a stepping platform and also a storage bowl. The invention makes it possible in a particularly simple manner to change from one to the other form of use. Furthermore the invention assures, that the ladder platform is at all times safely anchored to the ladder, without that the danger exists, that the ladder platform comes loose by itself during stress or while in operation. Furthermore it is particularly advantageous, that the inventive ladder platform has small dimensions, so that it can be stored space-savingly when not needed.

The invention is not limited to the illustrated exemplary embodiment, rather many possibilities for modifications result within the scope of the invention for the man skilled in the art.

The embodiments of the invention in which an exclusive property or privilege is claimed are defined as follows:

1. A ladder platform comprising a plate, which includes an upstanding peripheral edge extending from one surface of the plate and can be placed with its first end on a first crosspiece of a ladder, and comprising a suspension link supported on a second end of the plate and attachable to a second crosspiece of the ladder, wherein a mounting element is supported on the first end of the plate, which mounting element is pivotal about an axis parallel to the plate and which mounting element can form-lockingly engage the first crosspiece, wherein the mounting element includes two mounting plates, which are each pivotally supported on the outside of the edge of the plate, and a web connecting the mounting plates, and wherein the mounting plates each have a recess for receiving the first crosspiece.

2. A ladder platform according to claim 1, wherein the mounting plate has substantially a U-shaped cross section.

3. A ladder platform according to claim 2, wherein a first leg of the U-shaped cross section has a locking projection directed toward a second leg.

4. A ladder platform according to claim 3, wherein the second leg is provided with an incline for guiding the first crosspiece.

5. A ladder platform according to claim 3, wherein the web is fastened to the second leg of each U-shaped cross section mounting plate.

6. A ladder platform according to claim 2, wherein a base area of the U-shaped cross section of each mounting plate is pivotally supported on the edge of he plate.

7. A ladder platform according to claim 2, wherein the web is biased away from the first crosspiece by means of an elastic element.

8. A ladder platform according to claim 7, wherein the elastic element is arranged in the center area of the web.

9. A ladder platform according to claim 1, wherein the suspension link includes two parallel bars, which at one end are each supported pivotally about an axis parallel with respect to the pivot axis of the mounting element on the edge of the plate, and wherein the other ends are each partly circularly bent and are connected with one another by means of a diagonal trussing.

10. A ladder platform according to claim 1, wherein the second crosspiece is located above the first crosspiece when the ladder is oriented in a generally upstanding operative position.

11. A ladder platform according to claim 10, wherein said suspension link has a length which permits an operative, horizontally aligned positioning of said plate when (1) said mounting element engages the first crosspiece, (2) said suspension link is attached to the second crosspiece, and (3) the ladder is in said generally upstanding operative position.

* * * * *